US006071833A

United States Patent [19]

D'Alisa et al.

[11] Patent Number: 6,071,833

[45] Date of Patent: Jun. 6, 2000

[54] METHOD OF REPAIRING WALLS AND CEILINGS

[76] Inventors: Albert D'Alisa, 64 Union Valley Rd.; Scott Frey, 50 Buckshollow Rd., both of Mahopac, N.Y. 10541; Dana Owen, P.O. Box 589, Cross River, N.Y. 10518; Mark Viola, 55 Mill Plain Rd., 32-6, Danbury, Conn. 06811

[21] Appl. No.: 08/842,198

[22] Filed: Apr. 23, 1997

[51] Int. Cl.[7] ..... B32B 13/02

[52] U.S. Cl. ..... 442/42; 442/149; 156/71; 156/94; 428/63; 428/343; 428/350; 428/355 N; 428/355 R

[58] Field of Search ..... 428/63, 343, 350, 428/355 N, 355 R; 442/42, 149; 156/71, 94

[56] References Cited

U.S. PATENT DOCUMENTS

| | | | |
|---|---|---|---|
| 4,043,327 | 8/1977 | Potter et al. | 128/89 |
| 4,044,761 | 8/1977 | Hall | 128/90 |
| 4,102,338 | 7/1978 | Parket | 128/90 |
| 4,122,222 | 10/1978 | Parker | 428/66 |
| 4,123,416 | 10/1978 | Potter et al. | 260/42.18 |
| 4,135,017 | 1/1979 | Hoffman, Sr. | 428/78 |
| 4,243,567 | 1/1981 | Potter | 260/29.6 |
| 4,316,457 | 2/1982 | Liegeois | 128/156 |
| 4,358,495 | 11/1982 | Parker | 428/66 |
| 4,427,003 | 1/1984 | Fennimore et al. | 128/90 |
| 4,484,949 | 11/1984 | Potter et al. | 106/85 |
| 4,732,633 | 3/1988 | Pokorny | 156/94 |
| 4,776,906 | 10/1988 | Bernard | 156/85 |
| 4,793,879 | 12/1988 | Mimbs | 156/94 |
| 4,940,047 | 7/1990 | Richter et al. | 128/90 |
| 4,959,251 | 9/1990 | Owens et al. | 428/41 |
| 5,027,804 | 7/1991 | Forsyth et al. | 128/90 |
| 5,090,405 | 2/1992 | Jansen et al. | 602/8 |
| 5,256,134 | 10/1993 | Ingham | 602/8 |
| 5,269,861 | 12/1993 | Gilbreath | 156/98 |
| 5,334,442 | 8/1994 | Okamoto et al. | 428/246 |
| 5,382,466 | 1/1995 | Ingham | 428/219 |
| 5,403,267 | 4/1995 | Pearce et al. | 602/8 |
| 5,518,565 | 5/1996 | Castellucci et al. | 156/94 |
| 5,531,667 | 7/1996 | Webb et al. | 602/8 |

FOREIGN PATENT DOCUMENTS

| | | |
|---|---|---|
| 1139430 | 12/1967 | United Kingdom . |
| 1316129 | 12/1969 | United Kingdom . |

*Primary Examiner*—Terrel Morris
*Assistant Examiner*—Arti R. Singh

[57] ABSTRACT

A patch for repair or finishing of surfaces, such as drywall or plaster walls and ceilings, wherein the patch includes a liquid-hardenable material (such as a water-hardenable material) coated on and/or impregnated in a substrate or carrier. The patch is wetted and then applied to the surface of the wall or ceiling and pressed against the surface. The liquid-hardenable material becomes gel-like and adheres the patch to the surface. Upon drying, it sets to a hard coating overlying a hole, crack, recess or joint in the wall or ceiling. If necessary, joint compound or the like can be applied to the edges of the patch to provide a smooth taper to the surrounding surface. The liquid-hardenable material can be a cement, plaster, resin or glass composition. The carrier can be paper, or a fabric comprised of natural or synthetic fibers.

12 Claims, 1 Drawing Sheet

METHOD OF REPAIRING WALLS AND CEILINGS

BACKGROUND OF THE INVENTION

1. Field of the Invention

This invention relates to an improved patch for repair or finishing a surface, such as a dry wall or plaster surface as would be found in walls and ceilings.

2. Description of the Prior Art

Many different techniques have been described in the prior art for repairing defects such as holes, cracks and indentations in walls and ceilings. Typically, walls and ceilings are made of plaster or dry wall material, often referred to as sheetrock. Sheetrock is a material made of Plaster of Paris or the like that is sandwiched between cardboard inner and outer surfaces.

The usual method of repair is to first fill the hole with a backing material such as newspaper, wire mesh, etc. and then to apply a patching compound. This method is difficult since the backing material often moves and, even if it is stationary, a weak spot remains in the wall.

In a finish operation, such as that required to cover the space between two sheets of sheet rock, joint compound is applied over the joint and dry wall tape is pressed into the joint compound. After this, multiple applications of joint compound or spackle are applied over the dry wall tape in order to provide a smooth and tapered surface to the surrounding wall. This is a process which takes several days, since multiple layers of joint compound are required and because a certain amount of drying time must be allowed between applications of the different layers.

In the prior art, various types of patches have been described to more easily effect repair of broken surfaces in walls and ceilings. Most of these patches utilize a center portion intended to cover the hole or crack in the wall and an outer portion which is thinner than the center portion. This allows the patch to be tapered in order to provide a smooth transition between the patch covering the imperfection and the surrounding wall. Typically, the patch is adhered to the wall by application of glue, joint compound or spackling paste and the like, after which an additional coat of joint compound is applied to provide a smooth tapered surface between the patch and the surrounding wall. Examples of these prior art patches include those described in U.S. Pat. No. 4,776,906 (a heat-shrinkable film designed to provide a wrinkle-free patch);

U.S. Pat. No. 4,135,017 (a laminate patch employing a plate in the center of the patch and a plate cover thereover); or U.S. Pat. No. 4,959,251 (an elastic patch); U.S. Pat. No. 4,122,222 (a preformed laminate having plaster or a spackling material in the center portion); or U.S. Pat. No. 4,398,495 (a laminate structure including dry wall papers held together by hardened joint compound). In order to use these laminates, they are first adhered to the wall or ceiling by the use of joint compound or glue. This creates an additional step requiring more time to effect the repair even though an improvement is provided over the traditional approach using a backing material inserted into the hole. Further, for surfaces that are not perfectly planar, the use of a rigid patch is limited.

The patch of U.S. Pat. No. 4,358,495 is intended to somewhat accommodate irregularities in the surface. This is accomplished by dipping the patch in water to make the dry wall papers flexible. However, only the dry wall papers become flexible. The hardened joint compound stays hard even when wetted. Further, this patch must be adhered to the wall surface using joint compound or a similar material which is an additional step. In this patch, the presence of hardened joint compound between the layers of dry wall paper is intended to provide a localized rigid backing material, and therefore serves a function similar to that provided by the aluminum sheet of U.S. Pat. No. 4,135,017.

The various patches described in the prior art, although providing advantages, all have features that are disadvantageous. These patches require joint compound or glue for initial attachment to the wall or ceiling surface, and are typically more costly laminate structures. Further, since they are laminates including multiple sheets of material, it is possible to have delamination or shifting of the laminate layers with respect to one another.

Accordingly, it is an object of the present invention to provide an improved patch for dry wall and plaster surfaces and method of use thereof, which can be adhered to a wall or ceiling without an additional coating of glue, joint compound or other similar material.

It is another object of this invention to provide an improved patch for dry walls and plaster surfaces which is inexpensive and easy to use.

It is another object of this invention to provide an improved patch and method for repairing imperfections in dry wall or plaster surfaces, or for finishing these surfaces.

It is another object of this invention to provide an improved patch for repair or finishing of wall or ceiling surfaces, which can be used on planar surfaces as well as non-planar surfaces, including inside and outside corners.

It is another object of this invention to provide an improved patch and method for repairing or finishing walls or ceilings in which the patch can be easily stored for later use.

BRIEF SUMMARY OF THE INVENTION

This patch can be used for repair or finishing of a surface, such as a dry wall or plaster surface of the type commonly found in walls and ceilings in homes and commercial buildings. The patch is comprised of a substrate, or carrier, on which is coated or into which is impregnated a liquid-hardenable material, which in a preferred embodiment is a water-hardenable material. In operation, the patch is wetted with the liquid and then applied over an area of a wall or ceiling that is to be repaired, and pressed against the surface to provide a smooth patch thereover. Upon application to the surface, the patch will adhere thereto, without requiring the need for a first layer of joint compound or the like. The liquid-hardenable material when wetted adheres the patch to the surface and then sets to a hard coating overlying the hole, crack, recess or joint in the wall or ceiling. If necessary, joint compound or the like can be put on the edges of the patch to provide a smooth taper to the surrounding surface. This requires only a single coat, so the entire repair or finishing operation is completed at one time.

The liquid-hardenable material, when fully hardened, can be lightly sanded, if needed, and thereafter painted. The liquid-hardenable material can be a cement, plaster, resin or glass composition. The substrate or carrier can be paper or a fabric comprised of natural or synthetic fibers. A particularly suitable patch is comprised of Plaster of Paris (a water-hardenable material) impregnated into an open weave substrate. Preferred hardenable materials are those which harden after application thereto of water or a water containing solvent.

These and other objects, features and advantages will be apparent from the following more particular description of the preferred embodiments.

BEST MODE FOR CARRYING OUT THE INVENTION

Although the structure of this invention is termed a "patch", it will be understood by those of skill in the art that the structure can also be used for finish operations. Such operations occur, for example, when walls are fabricated from sheets of dry wall material. When these sheets are nailed or screwed onto supporting studs or joists, small separations exist between adjacent sheets. These separations, or joints, are typically covered by dry wall tape and multiple layers of joint compound. When this is complete, finish sanding is applied to provide a smooth transition to the surrounding wall surfaces. In the practice of the present invention, the function of the dry wall tape and multiple coatings of joint compound are provided by the use of this novel patch in an elongated, strip or tape form.

This improved patch can be fabricated in any shape including square, rectangular, circular and elongated strips. The size and shape of the patch are arbitrary, the particular patch used depending upon the repair or finish operation to be undertaken.

Figure 1A:
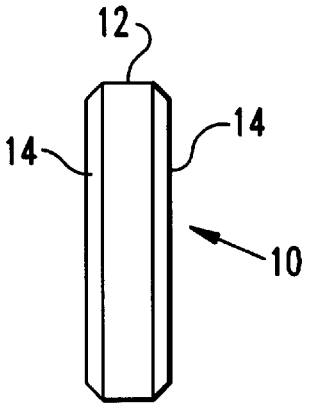
FIGS. 1A and 1B illustrate two views of the patch of this invention in which a substrate or carrier has coated on both sides thereof a liquid-hardenable material.
Figure 1B:
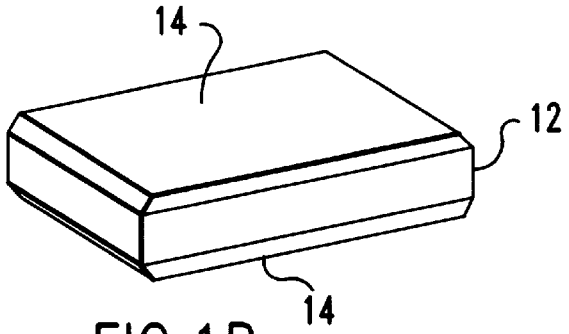

FIGS. 1A and 1B illustrate an embodiment of this invention in which a patch 10 is comprised of a substrate or carrier 12 having coated on both sides thereof a liquid-hardenable material 14. In this embodiment, the patch has an elongated shape such as a strip or tape. Of course, the patch can be of any shape including circular, square, rectangular, or an irregular shape. It is also possible to cut the patch into any desired shape for working in areas which may, for example, be very small or difficult to reach.

Figure 2A:
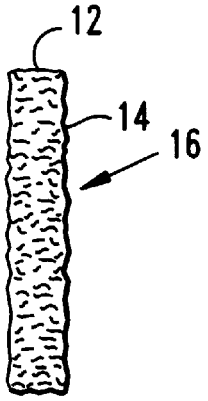
FIGS. 2A and 2B are two views of an improved patch in which a liquid-hardenable material is impregnated into the substrate or carrier.
Figure 2B:
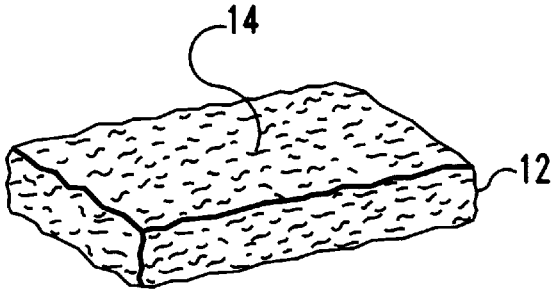

In FIGS. 2A and 2B, the patch 16 differs from patch 10 (FIGS. 1A, 1B) in that the liquid-hardenable material is impregnated into substrate 12, rather than being coated thereon. Thus, material 14 appears on both the front and back surfaces of substrate 12. Of course, the liquid-hardenable material 14 could be both coated onto and impregnated into the substrate 12. As in the embodiment of FIGS. 1A and 1B, the patch is shown having an elongated shape, such as a rectangular strip.

Figure 3A:
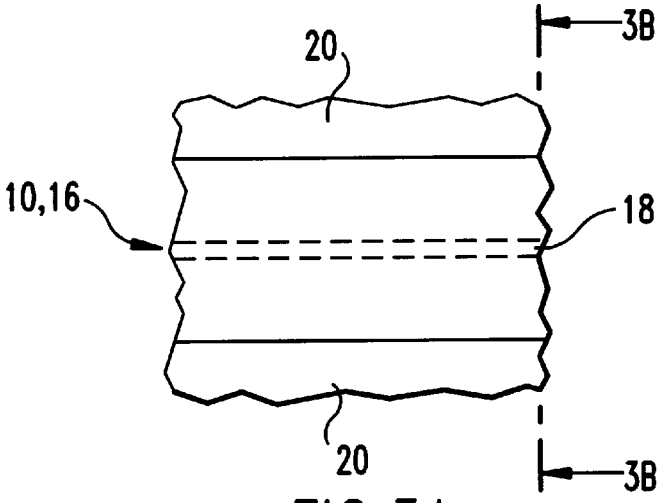
FIGS. 3A and 3B are two views illustrating the use of this patch to repair or finish a wall surface, in this case a surface having an elongated recess therein or a joint between two sections of dry wall.

FIG. 3A is a top view illustrating the application of this patch in a repair or finishing operation in which a crack (or hole, indentation, etc.) or joint 18 is to be covered. Joint or crack 18 can be in a single sheet of dry wall or can be formed between two sheets of dry wall 20 that have been nailed or screwed onto an underlying wood frame. Either patch 10 or patch 16 can be used to easily repair or finish a crack or joint 18.

Figure 3B:
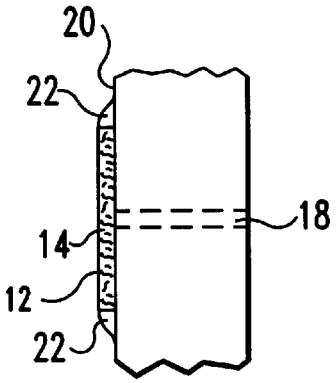

FIG. 3B is a side view of the structure of FIG. 3A, viewed along the direction of arrows 3B (FIG. 3A). Crack or joint 18 is covered by patch 10 or 16 where the substrate 12 is adhered to the surfaces of wall sections 20. If desired, a thin layer 22 of joint compound can be provided over the edges of the patch and the surrounding surfaces of wall sections 20.

It should be understood that many situations will occur that do not necessitate the use of an additional layer of joint compound 22. For example, the coating of liquid-hardenable material on the substrate 12, or the impregnation of this material into substrate 12, is over the entire area of the substrate. This means that the liquid-hardenable material will be present along the edges of the patch. When the patch is wetted prior to application to the wall or ceiling surface, this coating or impregnation can be used to make a smooth, tapered interface to the surrounding wall or ceiling surface. Upon light sanding over the entire patch, a smooth surface is obtained that can be directly painted or otherwise finished.

The substrate or carrier is used to support (carry) the liquid-hardenable material. It can be comprised of many materials such as paper or fabric. The fabric can be comprised of natural or synthetic fibers and can be woven or non-woven. In a preferred embodiment, the liquid-hardenable material is a water-hardenable cement, such as Plaster of Paris, impregnated into a porous or open weave substrate. Other substrates include cotton gauze and other woven or non-woven material based on multi-filamentary or spun yarns comprising synthetic polymers, such as polyamides, polyolefins and polyesters. Glass fiber fabrics are also suitable as substrate materials. Other suitable fibers include cellulosic fibers such as cotton, viscose or acetate rayon fibers. Both hydrophobic and hydrophilic fibers can be used.

The liquid-hardenable material 14 is one which, upon being wetted, enters a gel state or viscous state and then sets to become hard with good strength. When the liquid-hardenable material is in its gel state, the entire patch becomes flexible and can be attached to any flat or irregular topography (a convex or concave surface inside and outside corners, etc.). It is desirable that the material have minimal shrinkage upon drying and gel and set within a reasonable period of time. Examples of materials suitable as water-hardenable materials include various cements, resins, and glass compositions. A suitable cement is Plaster of Paris (POP), which is essentially calcium sulfate hemihydrate. When Plaster of Paris is used, it is supported on a fibrous material and/or impregnated into the fibrous material. When the patch is wetted, the entire patch is very flexible and can be used to repair surfaces that are non-planar. In this wet form, the patch can be manipulated and smoothed into a desired shape until it gels. Further, the wet Plaster of Paris adheres the patch to the surface without the need for a first coating of joint compound, glue or the like. The gel stage will take place over a few minutes time, after which it will set and harden sufficiently to provide a strong surface that optionally can be sanded. The setting process will typically take about 5–25 minutes depending upon the specific composition of the cement.

Another useful type of water-hardenable cement is an aqueous solution of one component added to another component in powdered form. One component can be a powdered ion leechable flouroalumino silicate glass and as the other component a poly (carboxylic acid) or precursor thereof is used. Ions leeched from the glass in the aqueous environment lead to cross-linking of the polymer to form a polycarboxylate cement. This type of cement can be put onto or impregnated into a substrate or carrier such as a woven cotton gauze or another woven or non-woven substrate comprised of multi-filamentary or spun yarns including synthetic polymers such as polyamides, polyolefins and polyesters. In practice, the substrate is contacted with a slurry containing that particulate and polymer in an anhydrous liquid, after which the liquid is allowed to evaporate.

The substrate contact is done by dipping, brushing, spraying or the like. Spreading is the preferable technique for most applications. The solids content of the slurry can be greater than 50% by weight. Suitable anhydrous liquids include a volatile organic medium such as methylene chloride. An adhesive or binder is usually present in the anhydrous solution. The binder or adhesive is soluble in both the medium and in water and serves to minimize the loss of solids when the patch is dipped in water prior to use. Suitable binders include hydroxyalkyl cellulose (such as hydroxypropyl cellulose). Up to about 5% of binder is preferable based on the solid content of the slurry.

These patches are dipped in water and applied to the wall or ceiling surface while wet. They are smoothed in place and manipulated to cover the joint or defect to be covered. After this, the patch is allowed to gel and set. Water uptake is usually about 50% of powder loading although variations can occur without affecting the utility of the patch.

Examples of suitable anhydrous cement compositions based on a calcium fluouroaluminum silicate glass are described in U.S. Pat. Nos. 4,123,416 and 4,043,327.

The water-hardenable cement can comprise a calcium based glass which does not contain fluorine. An example is a calcium aluminosilicate glass in a finely divided form, together with a polycarboxylic acid. These glasses are prepared by melting together silica, alumina, calcium oxide and the required alkali metal and/or titanium oxide. Specific compositions having various amounts of these components are described in more detail in U.S. Pat. No. 4,484,949. Such cements are loaded onto the substrate or carrier by coating or impregnation, the loading being at a weight of from about 50–600 grams/meter$^2$ of the cement composition. Patches made in this manner can be rolled on a support core and unrolled therefrom and cut to any specific size. When loading onto the substrate or carrier, a slurry of the water-hardenable cement composition in a volatile organic liquid is used. The organic liquid is any liquid which does not react with the cement base and which does not cause gelation. The organic liquid is removed by evaporation. Methylene chloride is a suitable organic liquid for this purpose. These types of cements and various compositions thereof are described in U.S. Pat. No. 4,484,949.

Variations of water-hardenable polycarboxylate cement are described in U.S. Pat. No. 4,243,567. These cement variations utilize a phosphate or borate glass containing at least one multivalent metal where the glass is soluble in aqueous conditions to form one reactive component capable of cross-linking a poly (carboxylic acid). The multivalent metal is preferably calcium, aluminum or zinc. Other metals that can be used include magnesium or barium and iron, chromium, copper or vanadium.

In addition to cements, the liquid-hardenable material can be a resin that is loaded onto the substrate. A suitable water-hardenable resin is an isocyanate terminated prepolymer which can be a reaction product of an aromatic isocyanate and a polyol containing a tertiary amino nitrogen. U.S. Pat. No. 4,427,003 describes a water-hardenable resin comprising isocyanate terminated prepolymer having a reaction functionality of not less than 2 in a catalyst that is water soluble but insoluble in the prepolyer. These resins can be loaded onto flexible fabric carriers having apertures of sufficient size to enable water to penetrate the substrate and react with the prepolymer. Millimeter size apertures ranging from about 2–100 mm are suitable for use in holding the prepolymer. Fabrics can include woven, knitted or non-woven fabrics made of a material which is inert to the prepolymer. Examples include polyester, polyamides, polyolefine and glass fibers. The prepolymer can be in a fluid form ranging from a liquid to a semi-solid in the patch. The prepolymer absorbs water so that rapid setting will take place. In use, the patches are immersed in water or brought into contact with water and then applied to the surface to be repaired or finished. There will be sufficient setting time to allow the patch to be positioned and smoothed over the wall or ceiling surface. Working times range to about 6–10 minutes. After this, the water-hardenable resin sets, usually taking about 5–30 minutes.

The prepolymer mixture can be prepared in a sufficiently fluid state to be coated onto the substrate carrier. The prepolymer mixture can also be coated in the form of a solution, a solvent dispersion or a hot melt. Coating can be done using a blade over a flat bed or a roller coating system. For many of these resins, it is necessary to protect them from moisture prior to their use. Accordingly, a package holding such patches will provide a dry atmosphere free of moisture vapor. This contrasts with cements, which won't absorb water so readily (although some type of package providing a vapor barrier may be beneficial).

Water-hardenable resins based on polyurethane prepolymer resins can also be used, and are described in more detail in U.S. Pat. No. 5,531,667. Examples are polyurethane or acrylic prepolymer hardenable resins. Such resins will be in a liquid state during impregnation or coating onto the substrate. It is preferred that the resin be liquid at temperatures between about 10°–30° C. Solid prepolymers or highly viscous polymers can be made liquid by a variety of methods, including hot melt or solvent methods, to facilitate the coating or impregnation of the substrate.

The improved patch of this invention has a very simple construction: a substrate or carrier and a liquid-hardenable material coated onto and/or impregnated into the substrate. The liquid-hardenable material is present over the entire area of the substrate, in contrast with other patches where only a center, or body, portion is designed to cover the wall imperfection. In use, the patch is wetted with the liquid and directly applied to the wall or ceiling to be repaired. The liquid-hardenable material in the patch causes the patch to adhere to the surface to be repaired or finished. Further, the material of the patch, when fully set, will provide a smooth and hard surface covering the imperfection in the underlying wall or ceiling surface. If cements are used, light sanding can be effected to ensure that the surface is sufficiently smooth. Optionally, a thin layer of joint compound or similar material can be applied around the edges of the patch to provide a very smooth tapered transition to the surrounding wall or ceiling.

Due to its particular construction, this patch is not subject to delamination or shifting of layers within the patch, as could be present in other patches based on preformed laminates. Further, the liquid-hardenable material extends over the entire area of the patch, rather than being located only in the central portion of the patch that is to cover the defect in the wall or ceiling. Because of this, the entire patch (not just the periphery of the patch) becomes flexible when wetted, making it suitable for use on any uneven surface, such as inside and outside corners or rounded (convex and concave) surfaces. This is a very attractive feature that is not available with rigid, preformed laminates.

While the invention has been described with respect to particular embodiments thereof it will be appreciated by those of skill in the art that variations can be made therein without departing from the spirit and scope of this invention, which is to be defined only by the appended claims. Such variations include the use of resins (certain shellacs, etc.) that are rendered gel-like (viscous) and settable upon the application of a suitable non-water-based liquid, such as an alcohol or other organic liquid.

Having thus described our invention what we claim as new and desire to secure by Letters Patent is:

1. A method of repairing or finishing a wall or ceiling surface having an imperfection therein using a patch comprising a substrate carrying a liquid hardenable material said patch being a sheet having an area larger than the area of said imperfection, including the steps of:

wetting said patch with said liquid to transform said liquid-hardenable material to a flexible gel state, applying said wetted patch over said imperfection in said surface to be repaired or finished and adhering said patch to said wall or ceiling surface by pressing said wetted patch against areas of said surface surrounding said imperfection, applying a thin layer of joint compound or similar material smoothly across the edges of said patch to provide a gradual taper between said patch and the surrounding surface of said wall or ceiling, allowing such liquid-hardenable material to set and become hard to provide a patch yielding a hard coating on said wall or ceiling surface.

2. The method of claim 1, in which said liquid-hardenable material is a cement.

3. The method of claim 1, where said liquid-hardenable material is a resin.

4. The method of claim 1, where said liquid-hardenable material is a plaster and said substrate is porous.

5. The method of claim 4, where said porous substrate is an open weave fabric.

6. The method of claim 1, where said liquid-hardenable material is coated on opposing sides of said substrate.

7. The method of claim 1, where said liquid-hardenable material is a cement impregnated into said substrate.

8. The method of claim 1, where said liquid-hardenable material extends over the entire area of said patch.

9. The method of claim 1, where said liquid contains water.

10. The method of claim 1, where said liquid-hardenable material is a water-hardenable material.

11. The method of claim 1, where said liquid-hardenable material is impregnated into said substrate.

12. The method of claim 1, where said liquid-hardenable material is coated on said substrate.

* * * * *